US005188468A

United States Patent [19]

Dykes

[11] Patent Number: 5,188,468

[45] Date of Patent: Feb. 23, 1993

[54] TRANSPORT DEVICE

[75] Inventor: Norman A. Dykes, Glastonbury, England

[73] Assignee: Thorn EMI Electronics Limited, Middlesex, England

[21] Appl. No.: 481,327

[22] Filed: Feb. 20, 1990

[30] Foreign Application Priority Data

Feb. 21, 1989 [GB] United Kingdom ..... 8903919

[51] Int. Cl.[5] ..... B41J 13/03

[52] U.S. Cl. ..... 400/579; 400/630; 271/252

[58] Field of Search ..... 400/579, 630; 271/142, 271/226, 252, 245, 230

[56] References Cited

U.S. PATENT DOCUMENTS

| | | | |
|---|---|---|---|
| 4,023,793 | 5/1977 | Pietsch | 271/252 |
| 4,442,769 | 4/1984 | Kallin | 400/630 |
| 4,676,498 | 6/1987 | Kanemitsu et al. | 271/226 |
| 4,775,142 | 10/1988 | Silverberg | 271/251 |
| 4,830,356 | 5/1989 | Zoltner | 271/226 |
| 4,836,527 | 6/1989 | Wong | 271/252 |

FOREIGN PATENT DOCUMENTS

| | | | |
|---|---|---|---|
| 0019079 | 11/1980 | European Pat. Off. . | |
| 0255878 | 11/1986 | Japan | 400/579 |
| 549838 | 5/1974 | Sweden . | |
| 2171395A | 8/1986 | United Kingdom . | |

OTHER PUBLICATIONS

IBM Technical Disclosure Bulletin, vol. 26, No. 7A Dec. 1983, Arldt et al.

IBM Tecnical Disclosure Bulletin, vol. 23 No. 5, Oct. 1980, Arsenault et al.

*Primary Examiner*—Edgar S. Burr
*Assistant Examiner*—John S. Hilten
*Attorney, Agent, or Firm*—Keck, Mahin & Cate

[57] ABSTRACT

A transport device consists of a drive roller and a follower roller. The medium to be transported, for example a card, is inserted between the two rollers. The follower roller is able to pivot on its mountings in order to bring the medium to a predetermined orientation by applying a tractive force to the medium.

5 Claims, 2 Drawing Sheets

TRANSPORT DEVICE

This invention relates to transport devices. Such devices are used in the transportation of planar members, for example a sheet of metal, part of a paper roll, cardboard tickets or plastic credit cards, to feed the members into a processing equipment. Such a processing equipment then typically performs suitable processing in the case of a metal sheet, either printing or reading a mark in a particular position in the case of a ticket, or magnetically reading or encoding a magnetic stripe in the case of a credit card. In any of these cases it is necessary for the planar member to be fed into the processing equipment with a predetermined orientation relative to the equipment. Where the planar member is fed into the transport device manually the planar member may be tilted in the plane parallel to the direction of travel of the planar member, this causing erroneous printing or encoding.

In U.K. Patent Application G.B. 2083933 there is described a card transport device which includes a drive roller which is pivoted such that it produces both a driving force and a lateral alignment force. The lateral alignment force is then effective to force a card inserted into the device against the reference edge. Such a device suffers the disadvantage however that the drive motor for the drive roller must also be pivoted.

It is an object of the present invention to provide a transport device capable of feeding a planar member into a processing equipment such that the planar member has a pre-determined orientation with respect to a reference direction within the processing equipment but wherein the need to provide a pivoted drive motor is avoided.

According to the present invention there is provided a transport device comprising: a drive roller capable of rotation about a predetermined axis; and at least one follower roller arranged to be driven by the drive roller, the axis of rotation of each follower roller is capable of lying in a different direction to the predetermined axis such that a planar member inserted between the drive roller and each follower roller will experience a force in a direction parallel to the predetermined axis.

By virtue of the lateral force thus produced on the planar member, it is possible to introduce the card to the system without requiring critical alignment with a reference edge.

The follower roller is suitably spring loaded against the drive roller.

Preferably, the follower roller is pivoted such that its axis of rotation is variable within a plane parallel to the plane containing the predetermined axis. Thus, the tractive force experienced by the card will always be in the same direction irrespective of the direction of rotation of the drive roller and hence the direction of rotation of the follower roller.

Preferably the follower roller comprises: an outer race which is driven by the drive roller; and a pivoted inner race, the two races being separated by a bearing means.

One particular card transport device in accordance with the present invention will now be described, by way of example only, with reference to the following drawings, of which:

Figure 1:
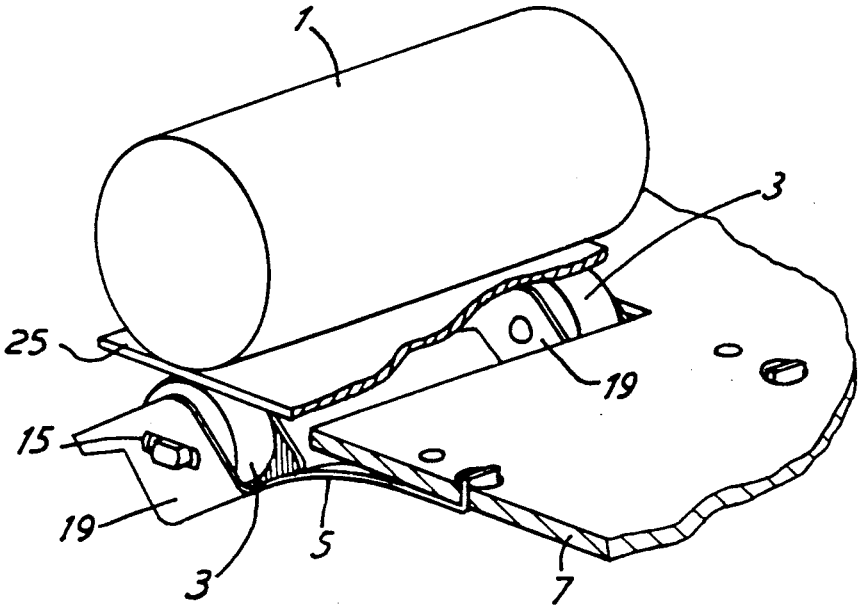
FIG. 1 is a schematic overall view of the device.
Figure 2:
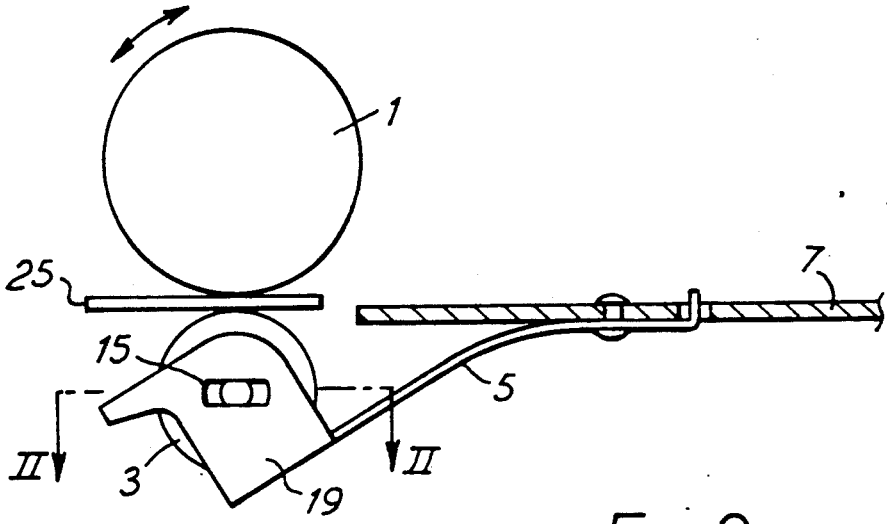
FIG. 2 is a schematic side view of the device.

Referring firstly to FIGS. 1 and 2, the device includes a drive roller 1 and a pair of follower rollers 3. Each follower roller 3 is held in spring-loaded contact with the drive roller 1 by a respective sprung follower arm 5. The follower arm 5 is attached to a support 7, only part of which is shown in the figures. The drive roller 1 is capable of rotation in either direction about a fixed axis, and is driven by a suitable rotational means, for example a drive motor and belt system (not shown).

Figure 3:
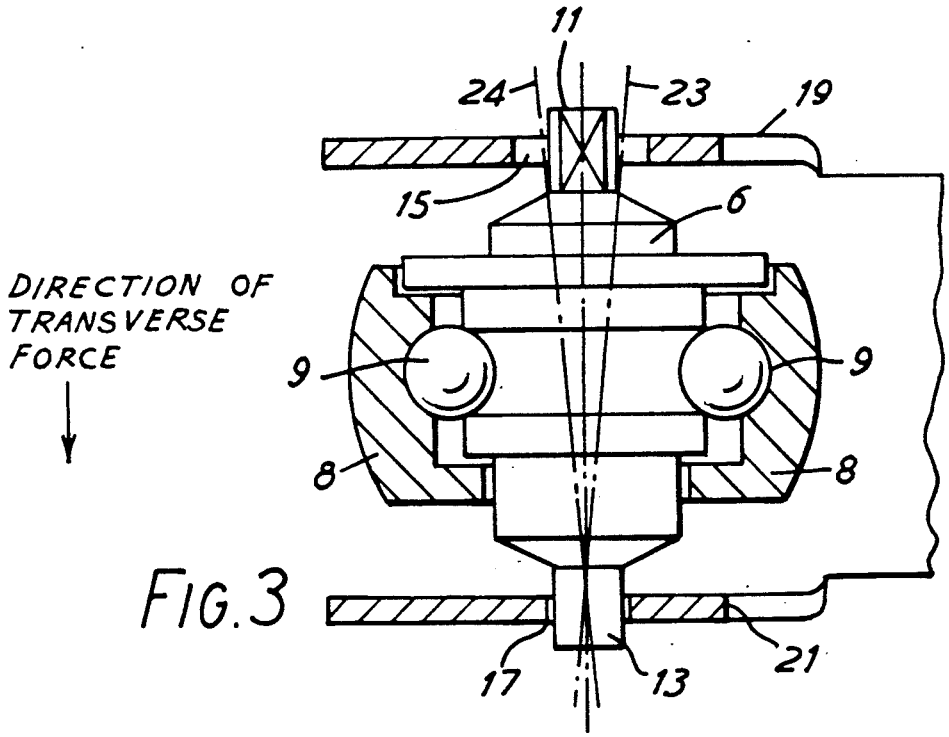
FIG. 3 is a section along the line II—II in FIG. 2 shown on an enlarged scale.

Referring now also to FIG. 3, each follower roller 3 comprises an inner race 6 and an outer race 8. The inner race 6 is designed to be non rotatable and is asymmetrically mounted via respective lugs 11, 13 in respective apertures 15, 17 in respective end brackets 19, 21 of the follower arm 5. The aperture 15 is extended in the horizontal direction such that the race 6 is effective to pivot about the lug 13 in the horizontal plane. This mounting arrangement allows the follower roller 3 to have a variable axis of rotation, the extremes of which are indicated by the lines 23, 24 and are dictated by the width of aperture 15 in which lug 11 is mounted.

The inner race 6 is separated from the rotatable outer race 8 by means of a rolling element ball bearing 9, the outer race 8 being driven by the drive roller 1.

During operation of the device, a planer member 25, for example, a ticket or a credit card, is inserted between the drive roller 1 and the pair of follower rollers 3. Because each follower roller 3 is spring-loaded against the drive roller 1, the card 25 is held between the drive roller and the two follower rollers and pulled through the device by the rotation of the drive roller 1. The movement of the card 25 causes rotation of the outer race 8 of the follower rollers 3.

As the mounting arrangement employed within each follower roller 3, enables the axis of rotation of the follower rollers 3 to vary between the positions indicated by 23 and 24, the axis of rotation of roller 3 will be generally parallel to, but lie along a different direction to the axis of rotation of the drive roller 1. The sense of the inclination will be determined by the direction of rotation of drive roller 1.

It will be seen that as a result of the translational movement of the lug within the aperture 15 the spring loaded arm 5 tends to twist so as to maintain true rolling contact of the follower roller 3 with either the drive roller 1 or the card 25.

It will be appreciated that the tractive force applied to the card 25, thus has a component in the direction indicated by the arrow in FIG. 2, i.e. parallel with the axis of rotation of the drive roller 1. Hence the card is forced into a predetermined orientation with respect to the transport device, thus enabling suitable processing, such as printing to be carried out. It will be seen that this transverse force will be in the same direction and equal in magnitude irrespective of the direction of rotation of drive roller 1, and hence the direction of rotation of follower roller 3.

It will be appreciated by those skilled in the art that any suitable material may be employed for construction of both the drive and follower rollers.

It will further be appreciated that any suitable means may be employed for the bearing mechanism, a rolling element ball bearing being shown only as an example.

It will also be appreciated that whilst it is particularly convenient for the follower roller to comprise a rotatable outer race, and a non-rotatable inner race, in some transports in accordance with the invention, the follower roller may comprise a roller which is rotatably pivoted about its central axis. In such circumstances, however, it will be necessary to provide a suitable bearing means between the part of the follower roller which co-operates with the supporting bracket, and the bracket, the bearing means permitting the necessary translational movement to allow the variation of the direction of axis of rotation of the follower roller. A fluid bearing might be appropriate in such circumstances.

It will also be apparent that during operation several such device may be employed, for example, in sets of pairs situated side by side in order to allow the card inserted between the rollers to travel some distance inside a machine.

It will also be appreciated that whilst two or more follower rollers driven by a single drive roller enable a relatively large planar member to be transported by a device incorporating relatively small follower rollers, a device in accordance with the invention may incorporate a single follower roller.

I claim:

1. A planar member transport device comprising:

(a) a drive roller, the drive roller having a first axis of rotation about which the roller may rotate, (b) a follower roller having defined within it a second axis of rotation, the follower roller being rotatable about the second axis of rotation by rotation action of said drive roller and (c) a spring follower arm which carriers a mount for said follower roller, urges said follower roller against said drive roller and resiliently permits tilting of said second axis of rotation about a point of contact between said follower roller and said drive roller, said mount permitting pivoting of said second axis of rotation between first and second positions by rotation action of said drive roller, said pivoting being about a point situated asymmetrically with respect to said follower roller, said first and second positions being respective positions in which said second axis of rotation is skewed in mutually opposite senses relative to said first axis of rotation, such that when said follower roller is rotated by rotation action of said drive roller and a planar member is inserted between said drive roller and said follower roller, the planar member experiences a force having a component in a direction parallel to said first axis of rotation, said direction being the same regardless of the direction in which said follower roller is rotated, said follower roller having a periphery which is convex and arcuate in a plane containing said second axis of rotation, wherein said mount comprises: a bracket means, two lugs, and two mounting means, each mounting means having defined within it a respective aperture, each lug being mounted within a respective one of said apertures, each mounting means being defined within one of said follower roller and said bracket means, the respective lug mounted within said mounting means being carried on the other of said follower roller and said bracket means, the aperture defined within one of the mounting means being substantially greater in dimension in a direction joining said first and second positions than the aperture defined within the other of said mounting means, so as to permit a transverse movement of the lug mounted in said aperture of greater dimension, thereby enabling said pivoting of said second axis of rotation.

2. A transport device according to claim 1 in which the follower roller comprises: an inner race, an outer race and a bearing means; said outer race being driven by the drive roller, and said inner race being pivoted, the two races being separated by said bearing means.

3. A transport device according to claim 2 in which the bearing means comprises a rolling element ball bearing.

4. A transport device according to claim 1 wherein the drive roller is arranged to drive a plurality of follower rollers.

5. A transport device comprising:

(a) a drive roller, the drive roller having a first axis of rotation about which the roller may rotate, (b) first and second follower rollers each having defined within it a respective axis of rotation, each follower roller being rotatable about its respective axis of rotation by rotation action of said drive roller, and (c) a respective sprung follower arm corresponding to each said follower roller, each follower arm carrying a mount for the corresponding follower roller, urging the corresponding follower roller against said drive roller and resiliently permitting tilting of the axis of rotation of the corresponding follower roller about a point of contact between the corresponding follower roller and said drive roller, each said mount permitting pivoting of the axis of rotation of the corresponding follower roller between first and second positions by rotation action of said drive roller, said pivoting being about a point situated asymmetrically with respect to the corresponding follower roller, said first and second positions being respective positions in which the axis of rotation of the corresponding follower roller is skewed in mutually opposite senses relative to said first axis of rotation, such that when said follower rollers are rotated by rotation action of said drive roller and a planar member is inserted between said drive roller and each follower roller, the planar member experiences a force having a component in a direction parallel to said first axis of rotation, said direction being the same regardless of the direction in which each follower roller is rotated, each follower roller having a periphery which is convex and arcuate in a plane containing the axis of rotation of the corresponding follower roller, wherein each mount comprises: a bracket means, two lugs, and two mounting means, each mounting means having defined within it a respective aperture, each lug being mounted within a respective one of said apertures, each mounting means being defined within one of the corresponding said follower roller and said bracket means, the respective lug mounted within said mounting means being carried on the other of the corresponding said follower roller and said bracket means, the aperture defined within one of the mounting means being substantially greater in dimension in a direction joining said first and second positions of the axis of rotation of the corresponding follower roller than the aperture defined within the other of said mounting means, so as to permit a transverse movement of the lug mounted in said aperture of substantially greater dimension, thereby enabling said pivoting of the axis of rotation of the corresponding follower roller: and wherein each said follower roller comprise an inner race, an outer race and a bearing means; said outer race being driven by the drive roller, and said inner race being pivoted, the two races being separated by said bearing means.

* * * * *

UNITED STATES PATENT AND TRADEMARK OFFICE

CERTIFICATE OF CORRECTION

PATENT NO. : 5,188,468
DATED : February 23, 1993
INVENTOR(S) : Norman A. Dykes

It is certified that error appears in the above-indentified patent and that said Letters Patent is hereby corrected as shown below:

Column 3, line 29, Claim 1, change "spring" to --sprung--.

Signed and Sealed this
Fifth Day of April, 1994

Bruce Lehman

*Attest:*

BRUCE LEHMAN

*Attesting Officer*

*Commissioner of Patents and Trademarks*